US005437564A

United States Patent [19]

Lignelet

[11] Patent Number: 5,437,564

[45] Date of Patent: Aug. 1, 1995

[54] ELECTRICAL CONNECTOR PROVIDED WITH A PLURALITY OF CONNECTION MODULES

[75] Inventor: Jacky Lignelet, Coudoux, France

[73] Assignee: Eurocopter France, Marignane, France

[21] Appl. No.: 221,882

[22] Filed: Apr. 1, 1994

[30] Foreign Application Priority Data

Apr. 5, 1993 [FR] France ..... 93 03976

[51] Int. Cl.[6] ..... H01R 13/502

[52] U.S. Cl. ..... 439/701; 439/731

[58] Field of Search ..... 439/359, 362, 364, 95–98, 439/607, 610, 686, 695, 701, 731, 465, 466, 458, 459, 905

[56] References Cited

U.S. PATENT DOCUMENTS

| | | | |
|---|---|---|---|
| 3,447,036 | 5/1969 | Dore et al. | 439/364 X |
| 3,742,119 | 6/1973 | Newman | 174/65 |
| 3,781,766 | 12/1973 | Teagno et al. | 439/731 X |
| 3,995,947 | 12/1976 | Lightner et al. | 439/364 |
| 4,123,629 | 10/1978 | Chagnon et al. | 439/364 X |
| 4,629,276 | 12/1986 | Genaro et al. . | |
| 4,889,500 | 12/1989 | Lazar et al. | 439/364 X |
| 4,966,374 | 10/1990 | Oikawa et al. | 277/178 |
| 5,007,858 | 4/1991 | Daly et al. | 439/364 X |
| 5,066,251 | 11/1991 | Lundberg et al. | 439/701 |
| 5,074,808 | 12/1991 | Beamenderfer et al. | 439/606 |

FOREIGN PATENT DOCUMENTS

| | | |
|---|---|---|
| 0470775 | 2/1992 | European Pat. Off. . |
| 0521751 | 1/1993 | European Pat. Off. . |
| 1273388 | 9/1961 | France . |
| 3149060 | 6/1983 | Germany . |
| 3127867 | 8/1983 | Germany . |

*Primary Examiner*—Khiem Nguyen

*Attorney, Agent, or Firm*—Marshall, O'Toole, Gerstein, Murray & Borun

[57] ABSTRACT

Electrical connector (CE) including a module carrier (PM) and a wiring chamber which are adjacent. The wiring chamber consists of two shells (C1, C2) which can be joined together, as well as to the module carrier (PM). Ducts (CH), consisting of two half-ducts which can be joined longitudinally, are provided for passage of the conductors. The ducts (CH) are held solidly fastened to the wiring chamber by being held captive between the two joined shells (C1, C2).

10 Claims, 6 Drawing Sheets

FIG. 2
PRIOR ART
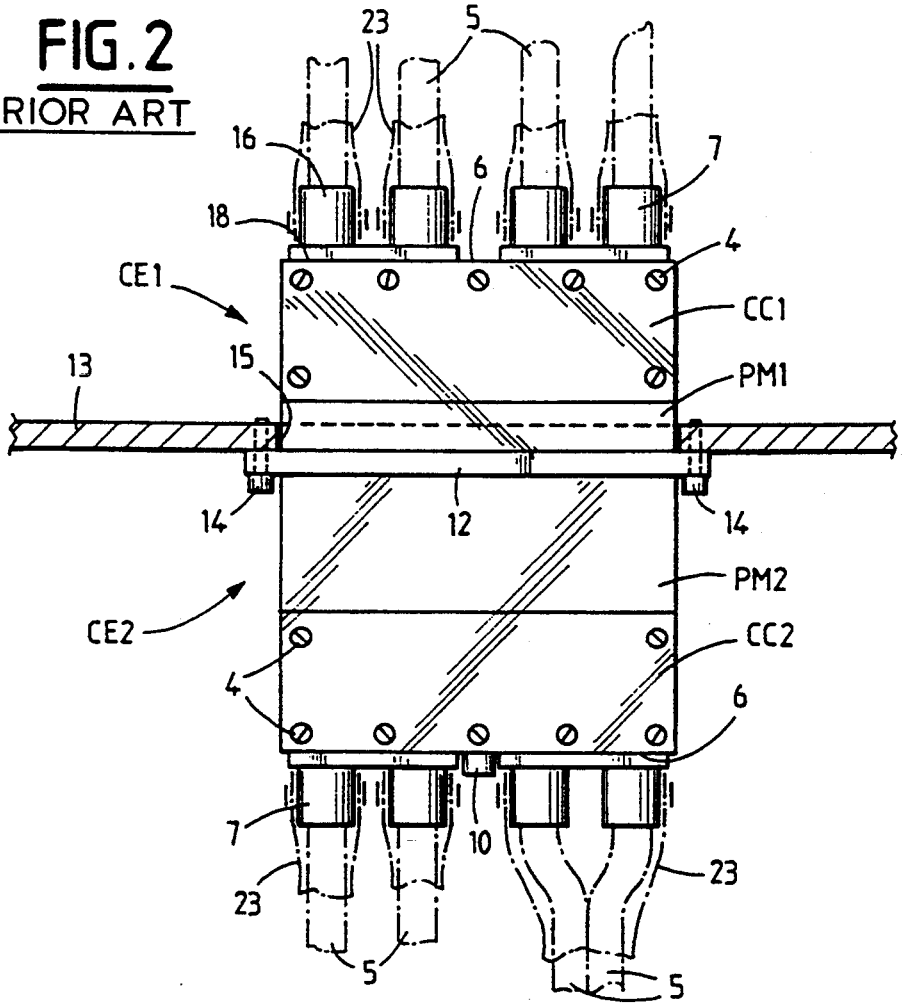
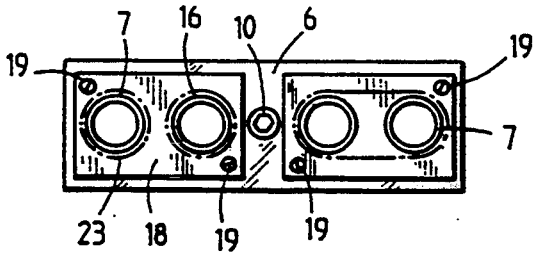
FIG. 3 PRIOR ART

ELECTRICAL CONNECTOR PROVIDED WITH A PLURALITY OF CONNECTION MODULES

The present invention relates to an electrical connector provided with a plurality of connection modules.

Electrical connectors which include a plurality of connection modules are already known, for example, from FR-A-2,115,556, FR-A-2,479,581, FR-A-2,489,609 and FR-A-2,501,428, which modules can be fitted onto a common support and through which pass connection members capable of establishing electrical connections between the front and rear faces of said modules, these faces being respectively opposite and facing said support. These prior documents describe various means for fixing each of said connection modules in the corresponding housing of said common support, as well as various embodiments for said connection members (male connector bodies and female connector bodies) which are preferably mounted in a removable way, (clipping-in), inside through-housings provided for this purpose in said modules.

Moreover, electrical connectors are found on the market, for example those under the DMC-M and DMC-MD references of the French company Compagnie DEUTSCH and under the SIM-N and SIM-D references of the French company AIR LB, which include a module carrier and a wiring chamber which are adjacent and made of aluminum alloy, said module carrier having a plurality of housings, generally four, into which may be inserted and held, for example by clipping-in, connection modules such as those described hereinabove. These modules form, for said connector, on the side opposite said wiring chamber, a plug-in face enabling said connector to be connected to a complementary electrical connector which is similar of different, but which is provided with a complementary plug-in face, and, on the side facing said wiring chamber, a connection face for the ends (generally provided with connection end-fittings) of electrical conductors penetrating into said wiring chamber through the wall thereof, said modules being provided for this purpose with connection members (such as those described hereinabove) passing through them in order to ensure electrical connection between said plug-in face and said connection face.

In these known connectors, the four modules are aligned so that the module carrier and the wiring chamber have an elongate and flattened section. Moreover, as is usual, in order to lock the plug-in of said connector and of its complementary connector, said connector includes a central through-screw, the control head of which appears outside said wiring chamber and which is capable of being screwed into a complementary threaded bush.

In a general way, in these known connectors, the module carrier and the wiring chamber are two different units fixed to each other by said locking through-screw and/or lateral press-screws. In addition, the wiring chamber is constituted by a flat casing closed off by a cover plate which is fixed to it by screws. This results in an appreciable number of screws (ten or so), so that the assembly of such a connector is lengthy (from 7 to 15 minutes). In addition, these screws are of small size and therefore fragile, and they risk causing damage to the conductors internal to said wiring chamber.

These known connectors, especially when they are intended to form part of the electrical circuits of an aircraft, are hardened, that is to say they are protected from electromagnetic interference, interference of the nuclear kind or otherwise, as well as from lightning and from spurious pickup from another on-board item of equipment. Thus, the disturbance and damage which could arise in the aircraft by the aforementioned causes, such disturbance and damage possibly even leading to the destruction of said aircraft, are avoided.

In order to harden such a connector, said module carrier and said wiring chamber are sealed with the aid of seals, especially between the modules and their housings in the module carrier and between said connection members and their housings in said modules, and ground continuity is provided between the various components. The structure of said known connectors does not allow systematic sealing and ground continuity at each joint.

In addition, still with the purpose of hardening the known connectors, ducts are provided for the conductor bundles to pass between said wiring chamber and the outside and said conductor bundles are covered with a conducting braid. It is thus possible to seal between the outside and the wiring chamber, by providing seals in said ducts, and to provide ground continuity between the conductors and the connector by connecting, for example with the aid of a metal collar, said braids of the conductor bundles to the corresponding ducts. Such ducts are simple cylindrical sleeves, of circular or oval section, made of conducting material, which project on the outside of said wiring chamber and which are either attached by screwing or made as a single piece with said wiring chamber.

Irrespective of the way in which they are fastened to said wiring chamber, it may be seen that these ducts increase the rigidity proper of the cable bundles, so that they increase the excessive bulkiness at the rear of said wiring chamber.

It may be seen that the ducts, when they are fixed to the wiring chamber with the aid of screws, increase the time to mount the connectors, already lengthy as mentioned hereinabove. In addition, in order to secure the metal braid of a conductor bundle to the corresponding duct correctly, it is preferable to demount said duct. It is then therefore necessary to screw said duct back onto the wiring chamber, which is a tricky and lengthy operation because of the rigidity and the bulkiness of the conductor bundles provided with conducting braid and of the collars enabling said braid to be clamped onto the duct. Moreover, it often happens that the part of the conducting braid covering said duct is damaged while remounting a duct on the wiring chamber.

On account of the fact that it is not possible to connect up conductors of the same bundle to all the modules, it is necessary to provide several bundles and therefore several ducts. This means that, for a single connector, it is essential to carry out several lengthy and tricky operations to secure conducting braids to ducts, and therefore to anticipate a significant amount of time for mounting.

Finally, since these ducts are constituted by a monobloc sleeve, it is virtually impossible to automate the mounting of the end-fittings of the conductors in said modules.

The object of the present invention is to overcome these drawbacks of the known connectors and to describe a connector making it possible to comply with the strictest standards of international regulations, especially in the aeronautical field, as regards protection against external electromagnetic interference, as well as to enable said connector to be mounted onto electrical conductors automatically.

To this end, according to the invention, the electrical connector, including a module carrier and a wiring chamber which are adjacent, said module carrier having a plurality of connection modules which form, on the side opposite said wiring chamber, a plug-in face enabling said connector to be connected to a complementary electrical connector, which is similar or different, but which is provided with a complementary plug-in face, and, on the side facing said wiring chamber via ducts solidly fastened to the wall of the latter, a said modules being provided for this purpose with connection members passing through them in order to provide the electrical connection between said plug-in face and said connection face, is noteworthy:

- in that said wiring chamber consists of two shells which can be joined together, as well as to said module carrier;
- in that said ducts consist of two half-ducts which can be joined longitudinally; and
- in that said ducts are held solidly fastened to said wiring chamber by being trapped between said two joined shells.

Thus, by virtue of such a structure, it is possible to arrange said shells and said ducts about the electrical conductors, after connecting these up to said module carrier, and to carry out easily the operations of connecting the conducting braids to the ducts (without having to slip these over the conductors before the connection to the module carrier) and of solidly fastening said ducts, thus connected to said conducting braids, to said shells.

Preferably, each half-duct is provided with a transverse base platelet, said platelets forming, after joining said half-ducts, transverse base plates for said ducts and slots are provided in the thickness of side walls of said shells, for example in the thickness of the rear walls, in order to serve as a housing for said transverse base plates.

Said half-ducts may have sections of any appropriate shapes, for example semicircular or U-shaped sections. In the latter case, the depths of the U's of two interacting half-ducts may be identical or different, so that it is possible to obtain any desired ovalization for the ducts.

Advantageously, in order to increase the sealing of said ducts, said half-ducts are joined along a longitudinal junction plane formed by interacting longitudinal shoulders. Thus, said junction plane forms transverse baffles opposing exchanges between the outside and the inside of the ducts.

It is also advantageous that the free edge of said side walls of said shells includes, plumb with said slots, curved cut-outs of shape corresponding to the external shape of said ducts, so that these curved cutouts match as closely as possible said ducts.

Advantageously, the module carrier includes, on the side of said wiring chamber, a frame surrounding said connection face and serving for the solid fastening of said shells to said module carrier. This frame may include a projecting peripheral rim capable of interacting with assembly slots provided in said shells. Thus the shells are mechanically fitted onto the module carrier.

Also for the purposes of good sealing of the wiring chamber, it is advantageous that said shells are joined along a junction plane formed by interacting longitudinal shoulders so as to form transverse baffles.

Screws may be provided for at least fixing said shells joined to each other.

The figures of the appended drawing will clearly explain how the invention may be realized. In these figures, identical references designate similar elements.

FIG. 2 illustrates, in plan view, the known connection device constituted by the two known electrical connectors of FIG. 1, connected to each other and mounted on a wall.

FIG. 3 is an end view of the rear face of said known connectors of FIG. 1.

Figure 1:
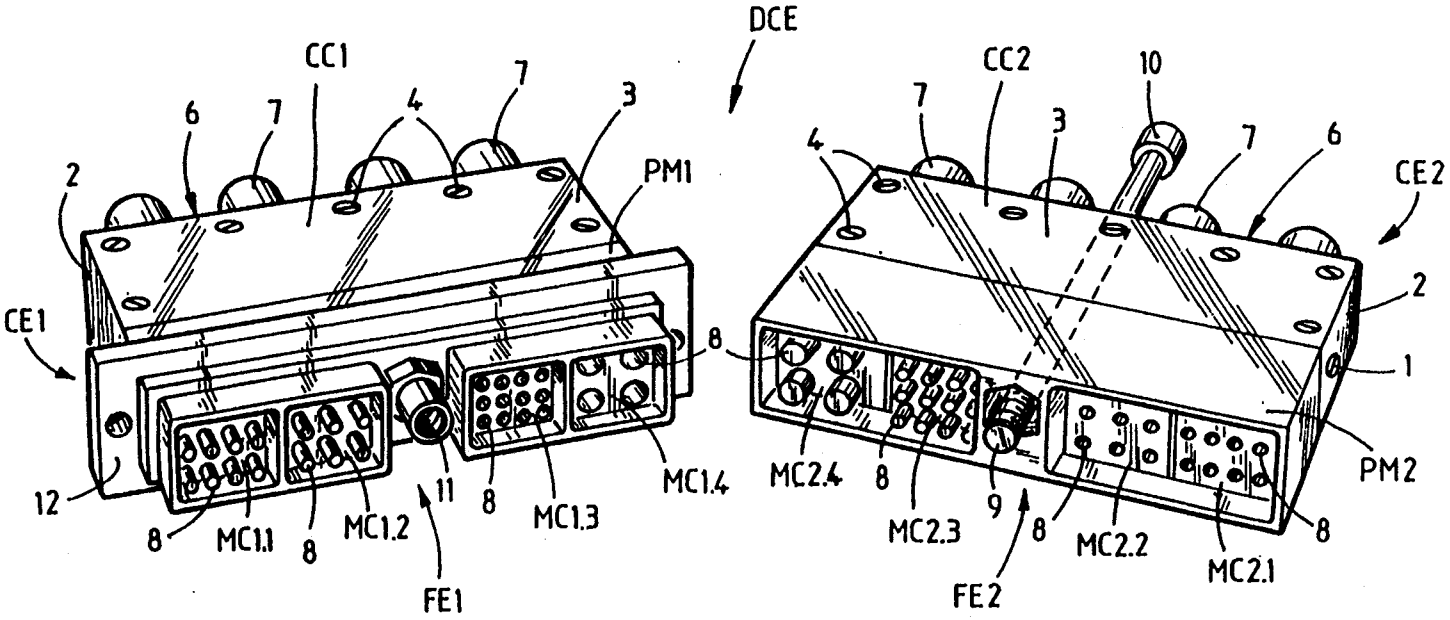
FIG.1 PRIOR ART
FIG. 1 shows, in perspective, two known complementary electrical connectors, not connected to each other.

The known DCE electrical connection device, shown by FIGS. 1 and 2, includes two complementary electrical connectors CE1 and CE2. Each electrical connector CE1 or CE2 includes a module carrier PM1 or PM2, respectively, and a wiring chamber CC1 or CC2, respectively, these being made of an electrically conducting material (for example aluminum alloy).

The wiring chambers CC1 and CC2 each form a unit, which is attached to the corresponding electrical connector CE1 or CE2 by fitting and which is fixed thereto by lateral screws 1. Each wiring chamber CC1 or CC2 is formed by a casing 2 and a coverplate 3 fixed to said casing by a plurality of screws 4.

Each module carrier PM1 or PM2 has a plurality of housings into which respectively connection modules MC1.1 to MC1.4 and MC2.1 to MC2.4 are inserted and held. Said modules are fixed in the corresponding housings by any known means, but not shown, for example by clipping-in. The connection modules MC1.1 to MC1.4 of the electrical connector CE1 form, on the side opposite the wiring chamber CC1, a plug-in face FE1 complementary to the plug-in face FE2 formed, on the side opposite the wiring chamber CC2, by the connection modules MC2.1 to MC2.4 of the electrical connector CE2.

On the side of the wiring chambers CC1 and CC2, said connection modules MC1.1 to MC1.4 and MC2.1 to MC2.4 form connection faces (not visible in FIGS. 1 and 2) for the ends of electrical conductors 5.

In the electrical connectors CE1 and CE2, the connection modules MC1.1 to MC1.4 and MC2.1 to MC2.4 are arranged in line, so that each of said electrical connectors has a flattened shape, which is elongate in the direction of the alignment of said connection modules.

The electrical conductors 5 penetrate into the wiring chambers CC1 and CC2, via the corresponding elongate rear face 6 of these, said face being opposite the plug-in face FE1 or FE2, through conducting ducts 7, fixed to said elongate faces 6.

Each connection module MC1.1 to MC1.4 and MC2.1 to MC2.4 is provided with connection members 8, for example male- and female-type pins passing through them, which are intended to provide the electrical continuity between the connection faces (not visible as they are arranged on the side of the wiring chambers and to which faces the ends of the conductors 5 are connected) and the corresponding plug-in faces FE1 and FE2, as well as between said plug-in faces FE1 and FE2, when said electrical connectors CE1 and CE2 are mated (see FIG. 2).

In order to lock said electrical connectors CE1 and CE2 in the mated position, provision is made for a through-screw 9 held captive on the electrical connector CE2 and provided with an operating head 10, capable of interacting with a threaded bush 11, solidly fastened to the electrical connector CE1. The module carrier PM1 of the latter may include a flange 12 enabling it to be fixed to a wall 13 with the aid of screws 14, at the periphery of an opening 15 into which said electrical connector CE1 is engaged.

Figure 4:
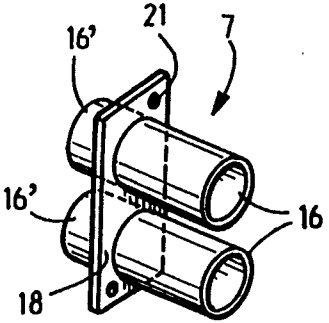
FIG. 4 PRIOR ART

As FIGS. 2 and 3, and more clearly FIGS. 4 to 7, show, the ducts 7 of the known electrical connectors CE1 and CE2 are constituted by sleeves 16 or 17, of cylindrical or oval section, solidly fastened to transverse base plates 18, which can be fixed to the rear faces 6 of the electrical connectors CE1 and CE2 by virtue of the screws 19. In the embodiment of FIG. 4, two cylindrical sleeves 16, through each of which a conductor 5 bundle (for example a cable) may pass, are solidly fastened to a common base plate 18. Of course, each cylindrical sleeve 16 may be provided with its own base plate. Each cylindrical sleeve 16 passes through the plate 18 and has a prolongation 16' capable of penetrating inside passages 20, provided in said rear faces 6, for the passage of the conductors 5 (see FIG. 7). (Threaded) holes 21 and 22 are respectively provided in the bases 18 and in the rear faces 6 for said fixing screws 19.

Figure 6:
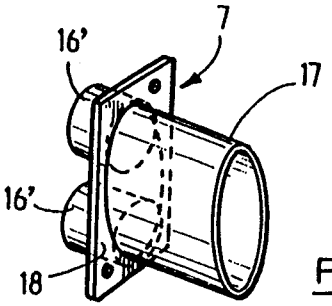
FIG. 6 PRIOR ART
FIGS. 4 and 6 illustrate, in perspective, two known embodiments for the ducts for passage of the electrical conductors.

In the embodiment, also known, of FIG. 6, the two cylindrical sleeves 16 of FIG. 4 are replaced by a single sleeve 17, of oval section, for the passage of two conductor 5 bundles, said sleeve 17 being prolonged, on the opposite side of the plate 18, by two prolongations 16', like those described previously.

Figure 7:
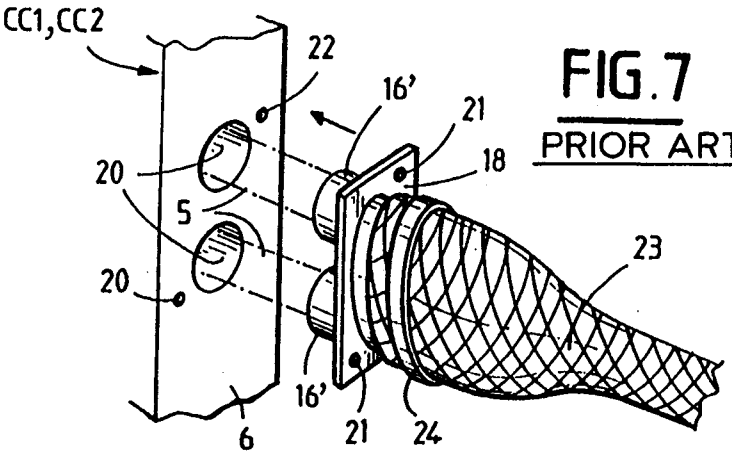
FIG. 7 PRIOR ART
FIGS. 5 and 7 illustrate, respectively, also in perspective, the ground connection between said ducts of FIGS. 4 and 6 and the metal braids surrounding the electrical conductors connected to said known connectors.
Figure 5:
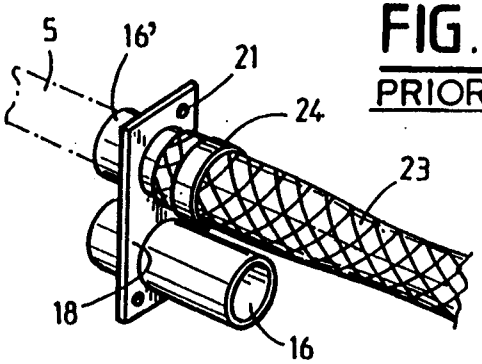
FIG. 5 PRIOR ART

As has been described hereinabove and is shown in FIGS. 2, 5 and 7 in order to provide the ground continuity, the electrical conductors 5 are surrounded by conducting braids 23, held in electrical contact with said ducts 7 by clamping collars 24, said conducting braids 23 and said clamping collars 24, for reasons of convenience, having to be solidly fastened to said ducts 7 before finally mounting the latter onto said wiring chambers CC1 and CC2.

From the previous description, with regard to FIGS. 1 to 7, (which has intentionally omitted the various seals, since they are well known in the art), it is found that it is virtually impossible to automate the mounting of the electrical connectors CE1 and CE2 onto the ends of conductors, because of the design of the wiring chambers CC1 and CC2 (large number of screws 4 for fixing the coverplates 3 onto the casings 2), of the design of the ducts 7 (which have to be slipped over the conductors 5) and of the way of fixing said ducts 7 to the connectors CE1 and CE2 by screwing.

In order to overcome this drawback, the electrical connector CE according to the invention, intended to replace one or other of said known connectors CE1 and CE2 described hereinabove essentially includes (see FIG. 8):

two shells C1 and C2 intended to form a wiring chamber CC (comparable to the wiring chambers CC1 and CC2) which can be joined together along a junction plane PJ, as well as to the module carrier PM (comparable to the module carriers PM1 and PM2), on the side opposite the plug-in face FE of the latter;

ducts CH intended to replace the ducts 7 and held solidly fastened to the wiring chamber CC by being held captive between the shells C1 and C2.

According to an important feature of the present invention, the conducting ducts CH consist of two half-ducts 30 which can be joined longitudinally.

Figure 9:
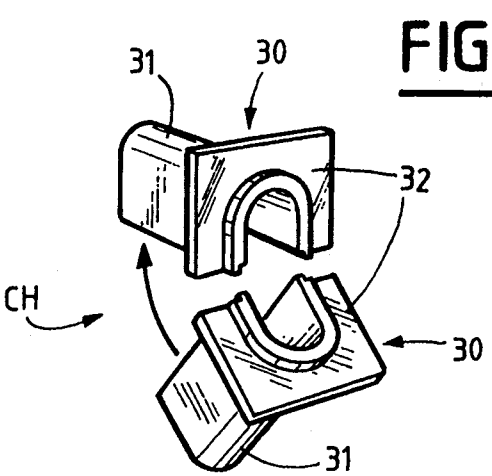
FIGS. 9, 10 and 11 illustrate embodiments of ducts, in accordance with the present invention.
Figure 10:
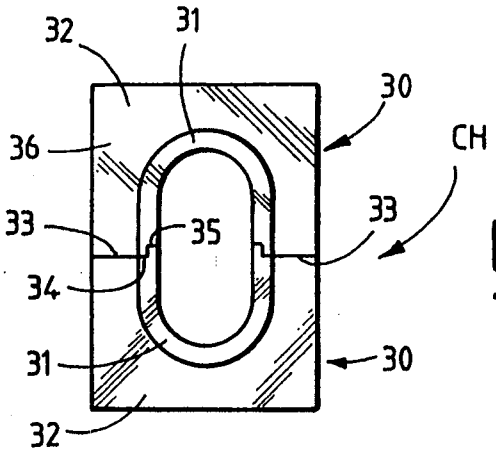

In the exemplary embodiment illustrated by FIGS. 9 and 10, each half-duct 30 consists of a part in the form of a channel 31, associated with a base part 32. The two parts in the form of channels 31 of the half-ducts 30 may have a semicircular section or (as shown) a U-shaped section. In this latter case, the U's may be identical or different, as regards their depth. The base parts 32 are in the form of rectangular platelets surrounding the convex part of said channels 31. The two half-ducts 30 can be joined longitudinally along a junction plane 33 which, preferably, as shown, is not flat, but includes interacting shoulders 34 and 35 capable of forming transverse baffles. Thus, better sealing of the ducts is obtained.

In FIG. 9, the duct CH is shown in exploded perspective view, whereas, in FIG. 10, the duct CH is shown in end view, joined up.

In this joined-up position the two platelets 32 form a baseplate 36.

Figure 11:
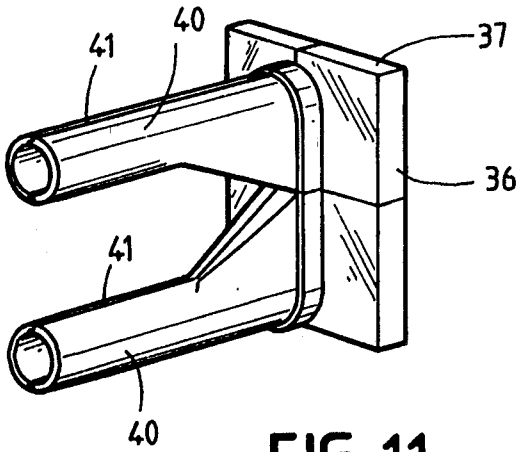

Numerous embodiment variants may be provided for the conducting ducts CH. For example, FIG. 11 shows, in perspective, an example of system of two circular channels 40, each channel being formed, as previously, by two half-channels joined longitudinally along junction planes 41. In this case, the baseplate 36 is formed by four joined base parts 37.

Figure 12:
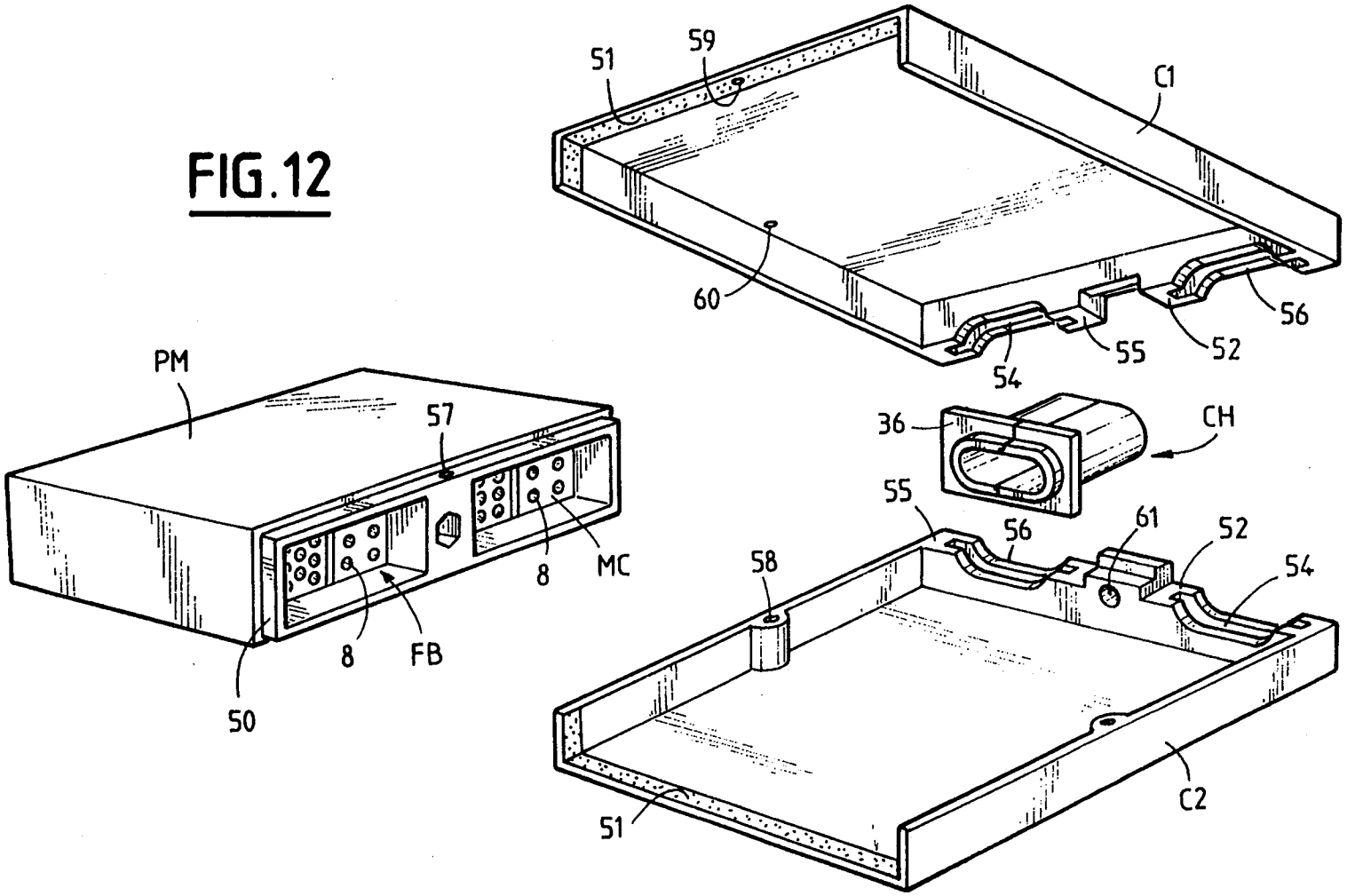
FIGS. 12 and 13 are exploded views, in perspective, of the main elements of two embodiments of the connector in accordance with the present invention.

In the exemplary embodiment of the connector in accordance with the invention, illustrated by FIG. 12, the module carrier PM includes a frame 50 around its connection face FB in which the connection modules MC (similar to the modules MC1.1 to MC1.4 or MC2.1 to MC2.4) appear. On the side facing the module carrier PM, each of the shells C1 and C2 has a bearing surface 51 intended to be applied against the frame 50.

On the side opposite the module carrier PM, each of the shells C1 and C2 includes a thick rear side wall 52, the two rear walls 52 being intended to form, for the connector CE, a rear wall 53 comparable to the rear wall 6 described hereinabove with regard to FIGS. 2 and 3. Slots 54 are made in the thickness of the rear side walls 52, these slots being intended to serve as a housing for base plates 36 of the duct CH (only one of which is shown). The free edges 55 of the rear walls 52 are cut out with a curve (at 56) plumb with the slots 54, so as to match the shape of the channels 31.

The friction between the base plates 36 and the walls of the slots 54 is capable of providing the electrical contact between the ducts CH and the shells C1 and C2.

It may easily imagined that, by virtue of the construction of the connector according to the invention, the shells C1 and C2 may be joined together, as well as to the module carrier PM, thereby trapping the ducts CH between them. For example, threaded holes 57 and 58 are provided in the module carrier PM and the shell C2 for a few screws (not shown) passing through the holes 59 and 60 of the shell C1 and intended to fix, between them, the various elements PM, C1, C2 and CH.

The rear walls 52 of the shells C1 and C2 may be arranged so as to make a passage 61 for the transverse assembly screw 9,10.

Figure 13:
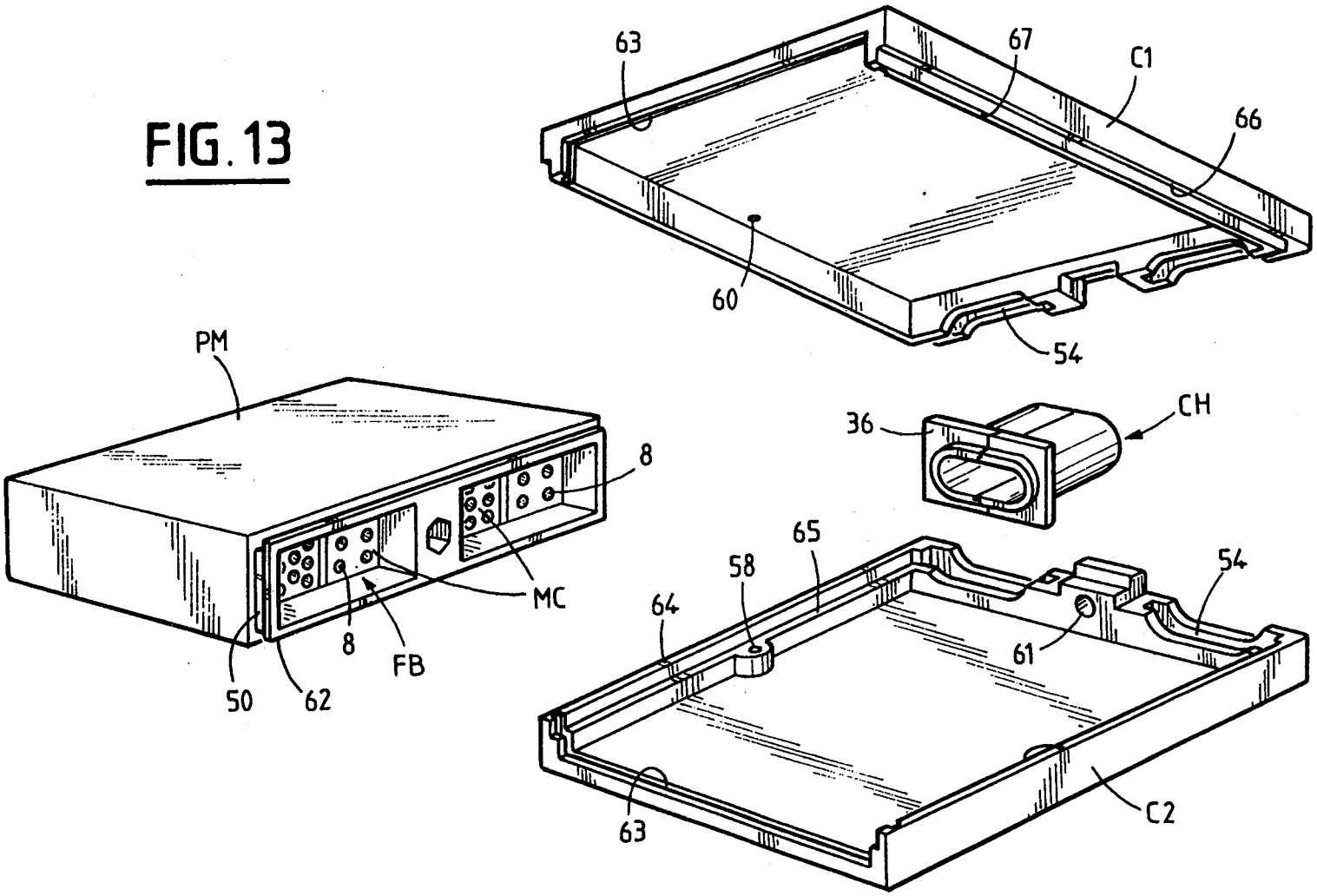

In the embodiment variant of FIG. 13, the elements of the connector of FIG. 12 are for the most part encountered again. However, in this case, the frame 50 includes a projecting peripheral rim 62, so that the bearing surfaces 51 are replaced by slots 63 made in the shells C1 and C2. In addition, there is provision that, instead of being plane, as in the exemplary embodiment of FIG. 12, the junction plane PJ includes interacting fitting shoulders 64 to 67, respectively provided on said shells C1 and C2.

In the connector of FIG. 13, the screw corresponding to the holes 57 and 59, and therefore these holes themselves, may be dispensed with.

In FIGS. 12 and 13, the various known seals, enabling the connector to be sealed, have not been shown.

It may easily be imagined that, by virtue of the structure of the connector in accordance with the present invention, it is possible to automate the mounting of the latter onto the ends of conductors 5. In fact, having dismantled the connector, it is easy to connect said ends of conductors to the connection members 8 of the module carrier PM, on the side of the connection face FB and then to enclose said conductors in the wiring chamber CC and to provide the ground connection between the conducting braids 23 and the ducts CH, by bringing the ducts CH and the shells C1 and C2 back around said conductors.

Figure 8:
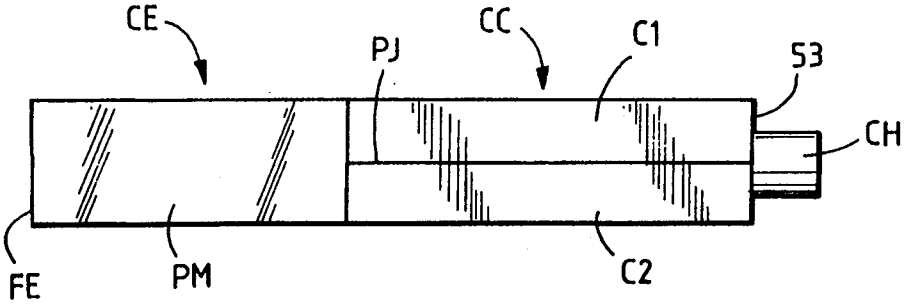
FIG. 8 is a diagrammatic side view of a connector in accordance with the present invention.

Although, in the exemplary embodiments of the connector in accordance with the invention which are described with regard to FIGS. 8, 12 and 13, it was assumed that the modules MC are aligned, it goes without saying that the present invention applies to any different arrangement of said modules. For example, these may be arranged in rows and columns in order to give said connector an at least approximately square section.

I claim:

1. An electrical connector comprising:

a module carrier having a plurality of connection modules, which form a front plug-in face enabling said connector to be connected to a complementary electrical connector and a rear connection face for the ends of electrical conductors, said modules being provided with connection members passing through said modules in order to provide the electrical connection between said front plug-in face and said rear connection face;

a wiring chamber adjacent said module carrier on the side of said rear connection face, said wiring chamber consisting of two shells which can be joined by fastening means;

ducts surrounding electrical conductors penetrating into said wiring chamber through a wall of said wiring chamber, said ducts consisting of two half-ducts which can be joined longitudinally;

said fastening means, when joining said two shells together, simultaneously acting for:

solidly fastening said shells to said module carrier;

solidly fastening together said two half-ducts of each duct; and solidly fastening said ducts to said wiring chamber, said ducts being trapped between said joined shells.

2. The electrical connector as claimed in claim 1, wherein each half-duct is provided with a transverse base platelet, wherein said platelets form, after joining said half-ducts, transverse base plates for said ducts and wherein slots are provided in the thickness of side walls of said shells in order to serve as a housing for said transverse base plates.

3. The electrical connector as claimed in claim 1, wherein each half-duct has a semicircular section.

4. The electrical connector as claimed in claim 1, wherein each half-duct has a U-shaped section.

5. The electrical connector as claimed in claim 1, wherein said half-ducts are joined along a longitudinal junction plane formed by interacting longitudinal shoulders on said half-ducts.

6. The electrical connector as claimed in claim 2, wherein the free edge of said side walls of said shells includes, plumb with said slots, curved cut-outs of shape corresponding to the external shape of said ducts.

7. The electrical connector as claimed in claim 1, wherein said module carrier includes, on the side of said wiring chamber, a frame surrounding said connection face and serving for the solid fastening of said shells to said module carrier.

8. The electrical connector as claimed in claim 7, wherein said frame includes a projecting peripheral rim, capable of interacting with assembly slots provided in said shells.

9. The-electrical connector as claimed in claim 1, wherein said shells are joined along a junction plane formed by interacting longitudinal shoulders on said shells.

10. The electrical connector as claimed in claim 1, wherein at least its joined shells are fixed to each other by screws.

* * * * *